US006185827B1

(12) United States Patent
Polites

(10) Patent No.: US 6,185,827 B1
(45) **Date of Patent: *Feb. 13, 2001**

(54) PROTECTIVE CASING FOR A SHAVING HEAD

(75) Inventor: Alexandra T. Polites, New York, NY (US)

(73) Assignee: Violex-bic S.A. (GR)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/942,672

(22) Filed: Oct. 2, 1997

(51) Int. Cl.[7] ..... B26B 21/40
(52) U.S. Cl. ..... 30/539; 206/354; D28/47
(58) Field of Search ..... 30/539, 540, 537, 30/32, 34.05, 47, 50; 206/349, 352, 354, 355, 356, 359; D28/47

(56) References Cited

U.S. PATENT DOCUMENTS

| | | | | |
|---|---|---|---|---|
| D. 210,713 | * | 4/1968 | Hamill et al. | D28/47 |
| D. 226,642 | * | 4/1973 | Ferrier, Jr. | D28/47 |
| 2,878,563 | * | 3/1959 | Schmoyer | 30/539 |
| 3,172,202 | * | 3/1965 | Sooter | 30/539 |
| 3,396,465 | * | 8/1968 | Knight et al. | 30/539 |
| 3,760,938 | | 9/1973 | Ferrier, Jr. | 206/16 BC |
| 3,880,284 | | 4/1975 | Pomfret | 206/354 |
| 3,915,300 | * | 10/1975 | Gatley | 30/539 |
| 4,328,902 | | 5/1982 | North | 220/23.4 |
| 4,476,630 | | 10/1984 | Byrne | 30/47 |
| 4,587,730 | | 5/1986 | Iten | 30/90 |
| 4,601,392 | | 7/1986 | Althaus | 206/349 |
| 4,742,909 | | 5/1988 | Apprille, Jr. et al. | 206/356 |
| 4,833,779 | | 5/1989 | Iten | 30/47 |
| 4,889,254 | | 12/1989 | Vola | 220/23.4 |
| 5,095,621 | | 3/1992 | Rapp | 30/90 |
| 5,518,114 | | 5/1996 | Kohring et al. | 206/352 |
| 5,893,213 | * | 4/1999 | Motta | 30/540 |

FOREIGN PATENT DOCUMENTS

| | | |
|---|---|---|
| 2587880 | 4/1987 | (FR) . |
| 2622174 | 4/1989 | (FR) . |
| 1145532 | 3/1969 | (GB) . |

OTHER PUBLICATIONS

Abstract of French Patent Document FR2587880, Apr. 3, 1987.

* cited by examiner

*Primary Examiner*—Hwei-Siu Payer
(74) *Attorney, Agent, or Firm*—Pennie & Edmonds LLP

(57) ABSTRACT

A protective casing for a shaving head has a hollow structure for receiving the shaving head. The hollow structure has a first side wall, a second side wall opposite the first side wall, and means for engaging the shaving head therein. The protective casing includes at least one projection on the outer surface of the first side wall and one or more projections on the outer surface of the second side wall. The projections on the second side wall form a space for interconnectingly receiving an element having the same shape as said at least one projection on the first side wall, whereby a plurality of protective casings may be interconnected.

12 Claims, 5 Drawing Sheets

PROTECTIVE CASING FOR A SHAVING HEAD

BACKGROUND OF INVENTION

This invention relates to a protective casing for a shaving head. The shaving head to which this invention relates may contain one or more shaving blades and may be either an integral part of a one-piece, disposable safety razor system or may be a cartridge that is detachably engageable with the handle of a safety razor system.

The need for protective casings for shaving heads has long been recognized. Such protective casings protect both users from accidental injury from exposed cutting edges of shaving heads and protect the shaving blades themselves from nicks and other damage. In general, the prior art consists of two types of protective casings: a casing for holding an individual shaving head (disclosed, for example, in U.S. Pat. Nos. 4,587,730 and 5,095,621) and a tray-type casing for holding a plurality of shaving heads (disclosed, for example, in U.S. Pat. No. 5,518,114).

Each of these types of protective casings has certain advantages and disadvantages. For example, individual protective casings may be simple and inexpensive to manufacture; yet, they may be inconvenient both to a manufacturer and a user for storing together multiple shaving heads. In contrast, while a tray is convenient for storing together multiple shaving heads, its flexibility is limited because it can only store a fixed number of shaving heads. In addition, a tray may be more difficult and expensive to manufacture than individual protective casings because of the precision required for the uniform placement of the common walls between shaving cartridges.

Another type of protective casing has been disclosed in U.S. Pat. No. 4,601,392, issued to Althaus. Althaus discloses individual protective casings that may be frangibly connected in a side-by-side relationship to form a razor blade pack. While combining some of the advantages of individual and tray-type casings, the casings disclosed in Althaus still have several shortcomings. First, once a protective casing is broken off from the pack, it can no longer be reattached. Second, there is always the concern that a frangible connection, once broken, may be jagged and dangerous to a user. Third, if the pack is integrally molded, the number of shaving heads sold together in a pack is fixed.

BRIEF SUMMARY OF THE INVENTION

The present invention is directed to an improved protective casing that combines ease of manufacturing, flexibility of use and storage, and safety of handling. According to the present invention, a protective casing comprises a hollow structure for receiving the shaving head, the hollow structure having a first side wall, a second side wall opposite the first side wall, and means for engaging the shaving head therein. The protective casing also comprises at least one projection on the outer surface of the first side wall and one or more projections on the outer surface of the second side wall. The projections on the second side wall form a space for interconnectingly receiving an element having the same shape as said at least one projection on the first side wall.

Preferably, the hollow structure, said at least one projection on the first side wall, and the projections on the second side walls are composed of a polystyrene-based material. In a preferred embodiment, said at least one projection on the first side wall is an elongated projection with a rounded cross-section disposed lengthwise along the longitudinal axis of the first side wall.

In another preferred embodiment, the projections on the second side wall comprise a row of top projections and a row of bottom projections. The projections in each row are arranged in an alternating pattern with respect to the projections in the other row, and together, the top and bottom rows of projections form a slot for interconnectingly receiving an element having the same shape as said at least one projection on the first side wall.

These and other features, aspects, and advantages of the present invention will become better understood with regard to the following detailed description, appended claims, and accompanying drawings.

DETAILED DESCRIPTION OF THE INVENTION

Figure 7:
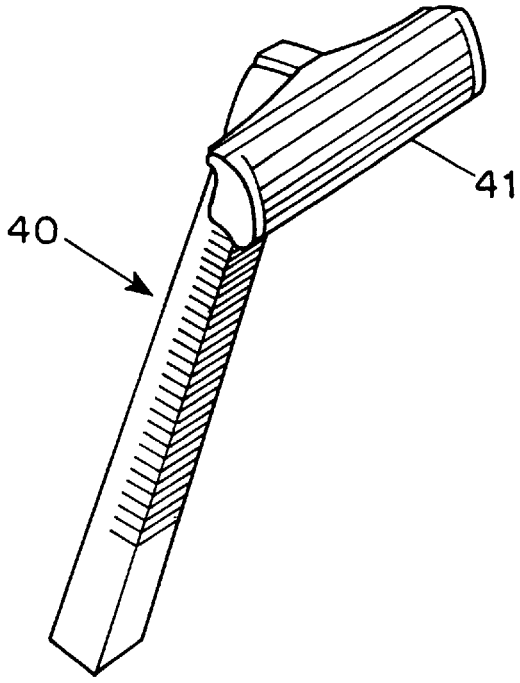
FIG. 7 is a perspective view of a one-piece, disposable safety razor.
Figure 8:
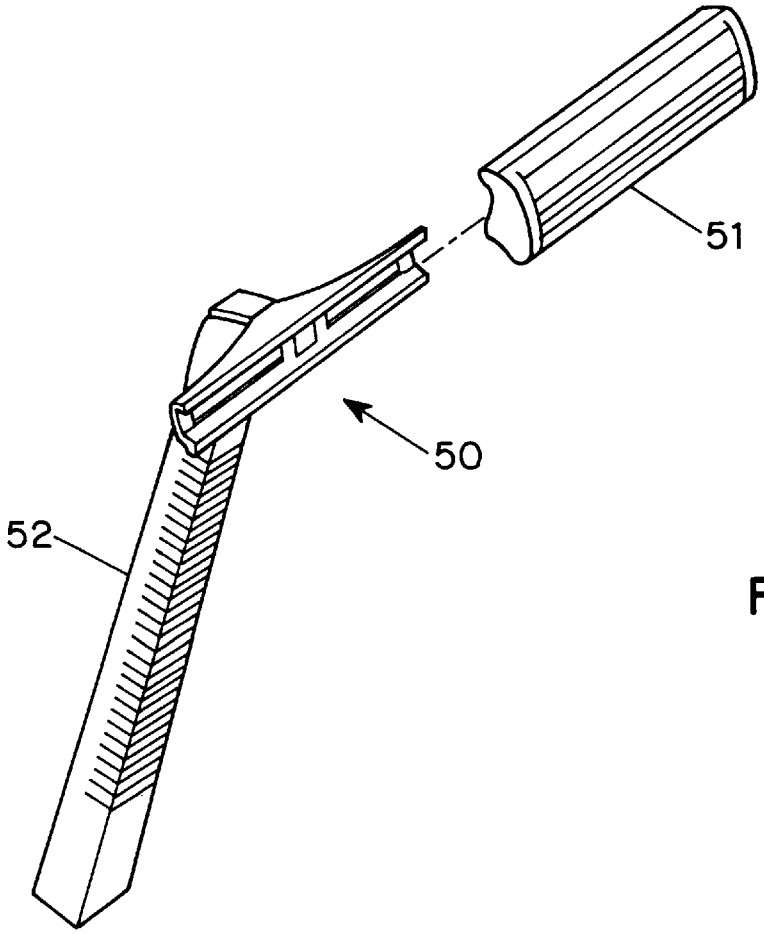
FIG. 8 is a perspective view of a safety razor system with a handle and detachably engageable shaving head.

As shown in FIGS. 1–4, a preferred embodiment of a protective casing according to the present invention includes a hollow structure 10 for receiving a shaving head. The shaving head to be used with the present invention may contain one or more shaving blades and may be either an integral part 41 of a one-piece, disposable safety razor 40 (as shown in FIG. 7) or it may be a cartridge 51 that is detachably engageable with the handle 52 of a safety razor system 50 (as 5 shown in FIG. 8).

Figure 1:
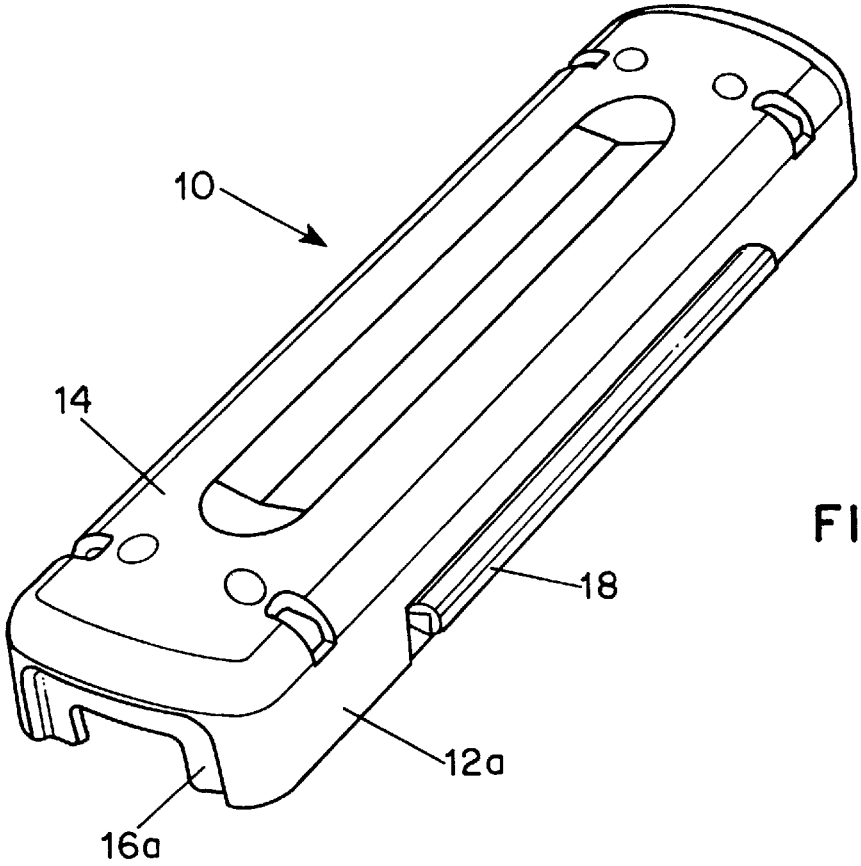
FIG. 1 is a perspective view of a protective casing according to a preferred embodiment of the present invention, showing the first side wall of the casing.
Figure 2:
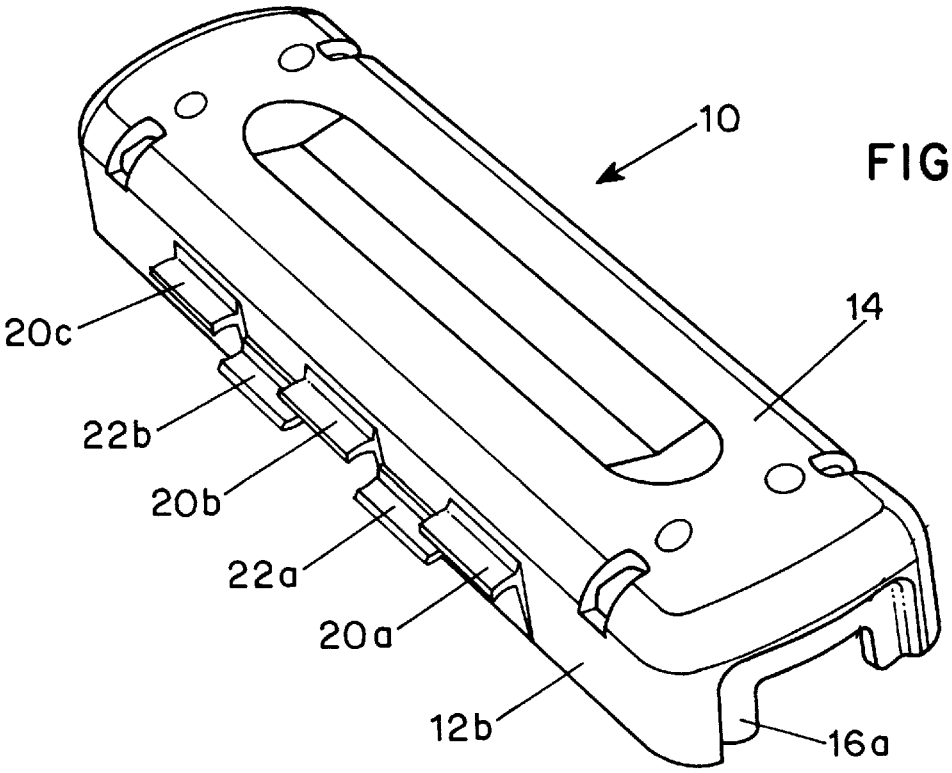
FIG. 2 is a perspective view of the protective casing of FIG. 1, showing the second side wall of the casing.

As best shown in FIGS. 1 and 2, the hollow structure 10 comprises a first side wall 12*a,* a second side wall 12*b* opposite the first side wall 12*a,* and a top wall 14. The hollow structure also has two end walls 16*a* and 16*b* opposite each other (as shown in FIGS. 1 to 4). The upper portions of the side walls and end walls are joined by the top wall 14. Preferably, the hollow structure 10 is composed of a polystyrene-based material.

Figure 6:
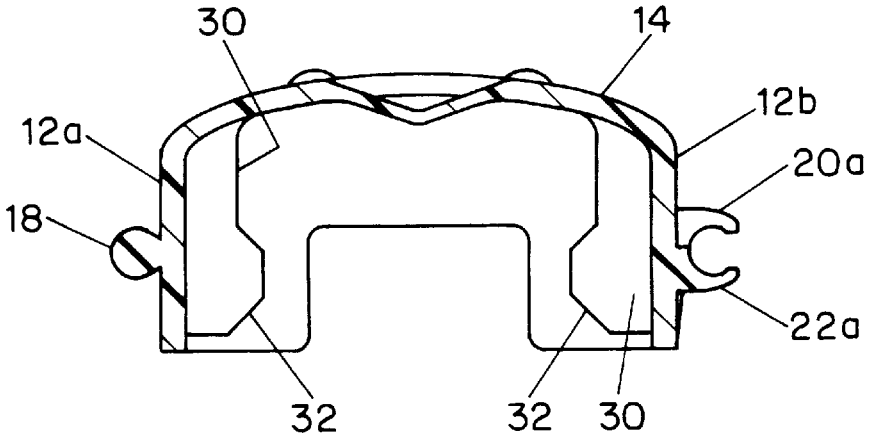
FIG. 6 is a cross-sectional view of the protective casing of FIG. 5 taken along line 6—6.

As shown in FIG. 6, the interior of the hollow structure includes means 30 for engaging the shaving head to retain structure 10 on the shaving head. The means 30 may be any means that is known in the art for engaging shaving heads. For example, as shown in FIG. 6, the means 30 may be posts with inwardly tapered areas 32. When the side walls 12*a* and 12*b* are formed of a resiliently yieldable material, the tapered areas 32 may be moved apart for insertion of the shaving head within the hollow structure 10 by pressing the razor head against the tapered areas 32 so as to cam the side walls 12*a* and 12*b* outwardly. Once the shaving head is inserted into hollow structure 10, the shaving head is retained therein. To remove a shaving head, the handle of the razor blade is used with a rocking motion to leverage the tapered areas 32 apart.

In a preferred embodiment, as shown in FIG. 1, the first side wall 12*a* has an elongated projection 18, which is rounded in cross-section (see FIGS. 4 and 6) and is disposed lengthwise along the longitudinal axis of the first side wall 12*a*. As shown in FIG. 2, the second side wall 12*b* has two rows of projections, a top row of projections 20*a*, 20*b*, and 20*c* and a bottom row of projections 22*a* and 22*b*. The projections 20*a*, 20*b*, and 20*c* in the top row are arced downward, and the projections 22*a* and 22*b* in the bottom row are arced upward. Together, the top and bottom rows of projections form a slot capable of interconnectingly receiving an element having the same shape as the elongated projection 18. Although as shown in FIGS. 1 and 2, a preferred embodiment contains three projections 20*a*, 20*b*, and 20*c* on the top row and two projections 22*a* and 22*b* on the bottom row, it is understood that any number of projections may be used. Also, the projection 18 on the sidewall 12*a* may be formed as a plurality of projections rather than as a single, elongated projection.

Figure 3:
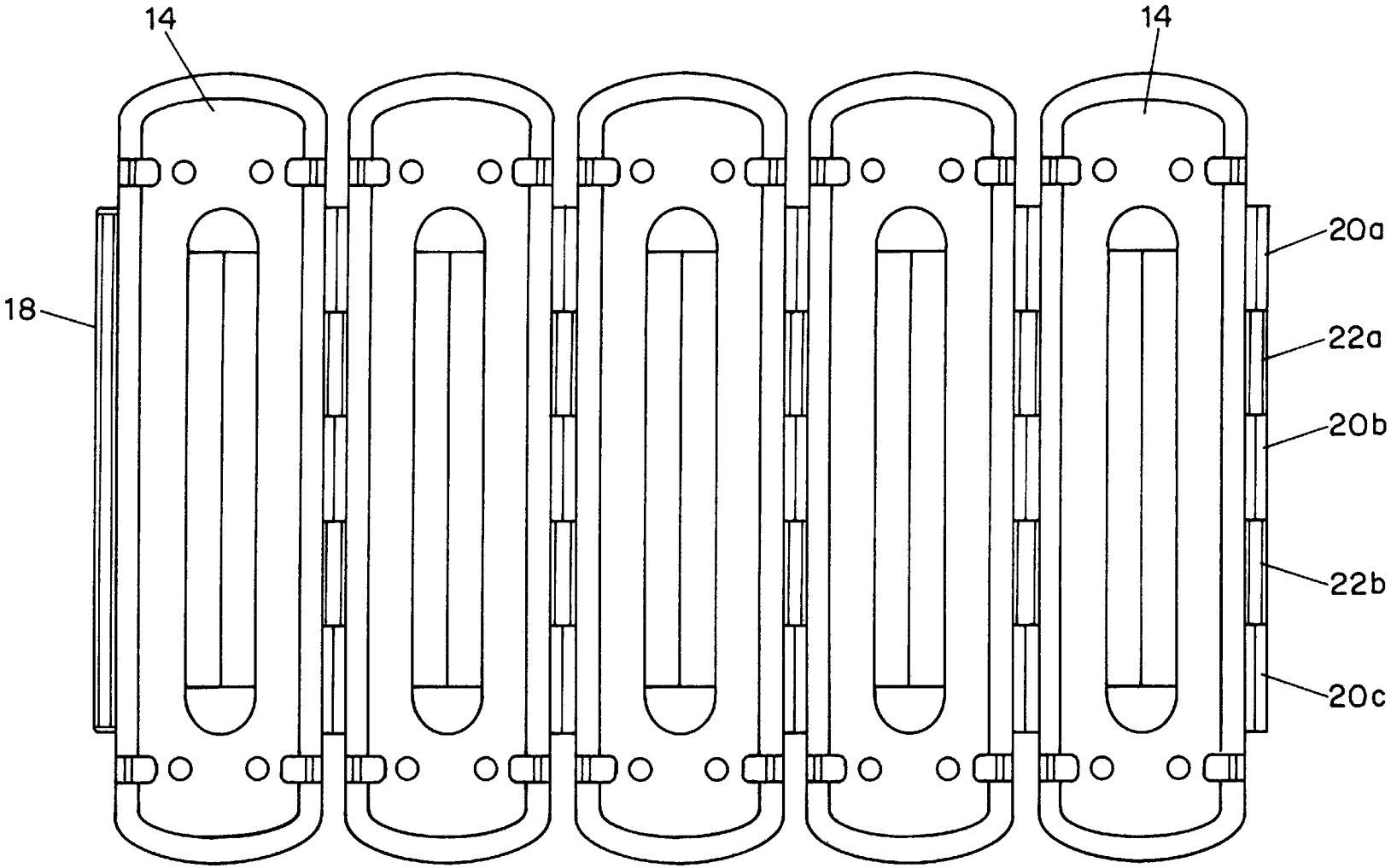
FIG. 3 is a top view of five interconnected protective casings according to the preferred embodiment of FIGS. I and 2.
Figure 4:
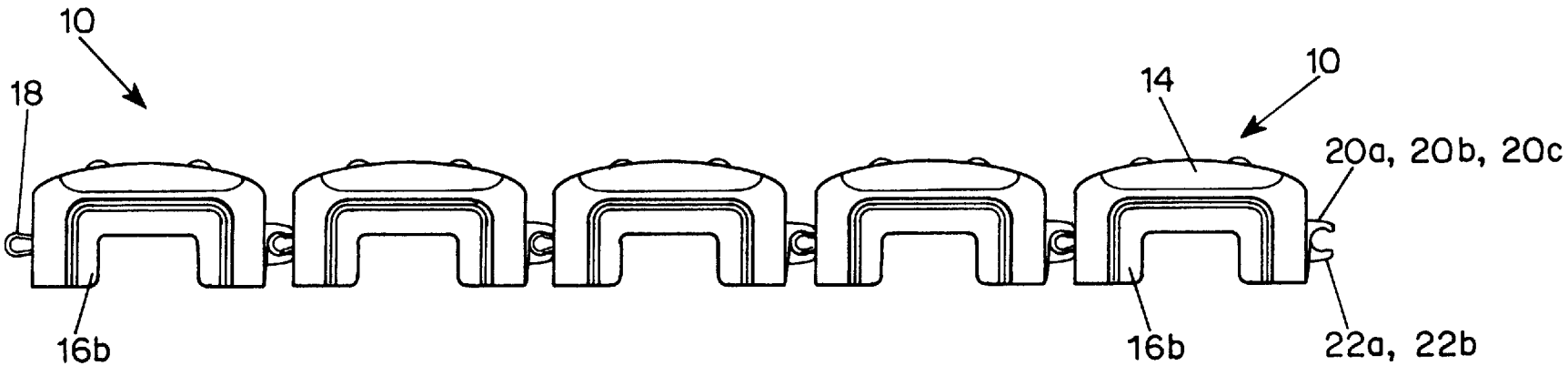
FIG. 4 is an end view of the five interconnected protective casings of FIG. 3.
Figure 5:
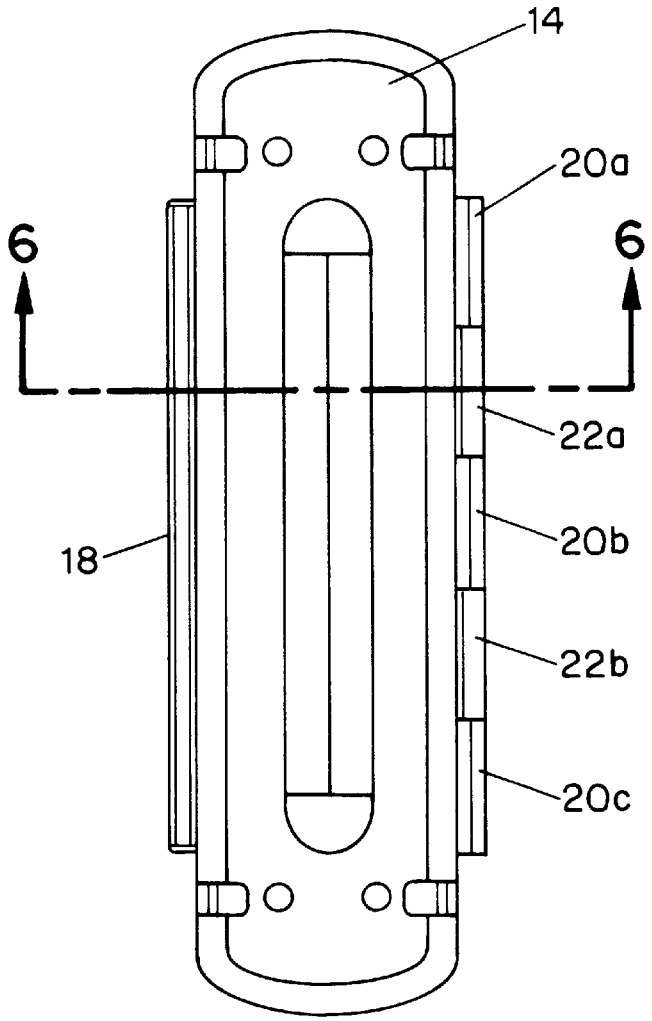
FIG. 5 is a top view of an individual protective casing according to the preferred embodiment of FIGS. 1 and 2.

As shown in FIGS. 3 and 4, the projections on the first side wall 12*a* and the second side wall 12*b* enable the interlocking connection of multiple protective casings. In one preferred embodiment, the protective casings are connected together by sliding the elongated projection 18 of one protective casing into the slot formed by the projections (20*a*, 20*b*, 20*c*, 22*a*, and 22*b*) on the second side wall 12*b* of another protective casing. Alternatively, in another preferred embodiment, the projections on the second side wall are manufactured from a resiliently yieldable material, and the elongated projection 18 may be snapped into the slot formed by the projections on the second side wall 12*b* by pushing the elongated projection 18 into the slot. Although five protective casings are shown connected together in FIGS. 3 and 4, it is obvious that the present invention allows any number of protective casings to be connected together. Moreover, the protective casings may be detached and reconnected as needed.

As shown in FIG. 2, the projections 20*a*, 20*b* and 20*c* in the top row are preferably arranged in an alternating pattern with the projections 22*a* and 22*b* in the bottom row. The use of an alternating pattern permits the use of a simple, two-plate injection mold for the manufacturing of the protective casings.

Although the present invention has been described with reference to certain preferred embodiments, various modifications, alterations, and substitutions will be known or obvious to those skilled in the art without departing from the spirit and scope of the invention, as defined by the appended claims.

I claim:

1. A plurality of interconnected protective casings for a shaving head, comprising:

a first end casing comprising a hollow structure shaped to retain a shaving head therein, the hollow structure having a first side wall, a second side wall opposite the first side wall, and one or more projections on the outer surface of the second side wall;

any number of inner casing s comprising a hollow structure shaped to retain a shaving head therein, the hollow structure having a first side wall and a second side wall opposite the first side wall, at least one projection on the outer surface of the first side wall, and one or more projections on the outer surface of the second side wall;

a second end casing comprising a hollow structure shaped to retain a shaving head therein, the hollow structure having a first side wall, a second side wall opposite the first side wall, and at least one projection on the outer surface of the first side wall;

wherein:

the one or more projections on the outer surface of the second side wall of the first end casing form a space for interconnectingly receiving a projection on the first side wall of an inner casing or the second end casing; and the one or more projections on the outer surface of the second side wall of an inner casing form a space for interconnectingly receiving a projection on the outer surface of the first side wall of another inner casing or the at least one projection on the first side wall of the second end casing.

2. The plurality of interconnected protective casings for a shaving head of claim 1, wherein the first end casing, the inner casings, and second end casing are composed of a polystyrene-based material.

3. The plurality of interconnected protective casings for a shaving head of claim 1, wherein the at least one projection of the first side wall of the inner casings and the at least one projection on the first side wall of the second end casing are the same shape.

4. The plurality of interconnected protective casings for a shaving head of claim 1, wherein the first end casing, the inner casings, and the second end casing have a top wall and the first end casing, the inner casings, and second end casing interconnect in a direction substantially parallel to the top walls of the first end casing, the inner casings, and the second end casing.

5. A protective casing for a shaving head, comprising:

a hollow structure for receiving the shaving head, the hollow structure having a first side wall and a second side wall opposite the first side wall wherein the hollow structure is shaped to retain the shaving head therein;

at least one projection on the outer surface of the first side wall; and one or more projections on the outer surface of the second side wall forming a space for interconnectingly receiving an element having the same shape as said at least one projection on the first side wall.

6. The protective casing of claim 5, wherein the hollow structure, said at least one projection on the first side wall, and the projections on the second side walls are composed of a polystyrene-based material.

7. The protective casing of claim 5, wherein said at least one projection on the first side wall is an elongated projection with a rounded cross-section disposed lengthwise along the longitudinal axis of the first side wall.

8. The protective casing of claim 7, wherein the projections on the second side wall comprise a row of top projections and a row of bottom projections, the projections in each row arranged in an alternating pattern with respect to the projections in the other row, the projections forming a slot for interconnectingly receiving an element having the same shape as said elongated projection on the first side wall.

9. A protective casing for a shaving head, comprising:

a hollow structure having a first side wall, a second side wall opposite the first side wall, and a top wall, the hollow structure being shaped to retain a shaving head; and one or more projections on the outer surface of the second side wall shaped to interconnectingly receive another protective casing by relative movement of the one or more projections with respect to said another protective casing in a direction substantially parallel to the top wall.

10. The protective casing of claim 9, wherein the hollow structure and the one or more projections on the second side wall are composed of a polystyrene-based material.

11. The protective casing of claim 9, wherein the one or more projections on the second side wall is an elongated projection disposed lengthwise along the longitudinal axis of the second side wall.

12. The protective casing of claim 9, wherein the one or more projections on the second side wall comprise a row of top projections and a row of bottom projections, the projections in each row arranged in an alternating pattern with respect to the projections in the other row to form a slot for interconnectingly receiving a projection on said another protective casing.

* * * * *